US012673253B2

(12) United States Patent
Pelletier et al.

(10) Patent No.: US 12,673,253 B2
(45) Date of Patent: Jul. 7, 2026

(54) COLLAPSIBLE SKATEBOARD

(71) Applicants: Ryan Douglas Pelletier, Midland, MI (US); James Chester Pawloski, Bay City, MI (US)

(72) Inventors: Ryan Douglas Pelletier, Midland, MI (US); James Chester Pawloski, Bay City, MI (US)

( * ) Notice: Subject to any disclaimer, the term of this patent is extended or adjusted under 35 U.S.C. 154(b) by 266 days.

(21) Appl. No.: 18/432,457

(22) Filed: Feb. 5, 2024

(65) Prior Publication Data

US 2025/0249340 A1 Aug. 7, 2025

(51) Int. Cl.
*A63C 17/01* (2006.01)

(52) U.S. Cl.
CPC ..... *A63C 17/012* (2013.01); *A63C 2203/10* (2013.01)

(58) Field of Classification Search
CPC ..... A63C 17/012; A63C 2203/10
See application file for complete search history.

(56) References Cited

U.S. PATENT DOCUMENTS 7,635,137 B2 * 12/2009 Gregory ..... A63C 17/0086 280/87.041
7,976,034 B1 * 7/2011 Hong ..... A63C 17/01 280/87.042
8,459,670 B1 * 6/2013 Tizzone ..... A63C 17/015 280/87.05
8,746,715 B2 * 6/2014 Woncik ..... A63C 17/0093 280/87.042
8,827,286 B2 * 9/2014 Woncik ..... A63C 17/0006 280/87.042
8,910,959 B2 * 12/2014 Alva ..... A63C 17/015 280/87.05
9,095,766 B1 * 8/2015 Christie ..... A63C 17/01
9,504,901 B1 * 11/2016 Lu ..... A63C 17/015
10,071,302 B2 * 9/2018 Sala ..... A63C 17/015
10,092,818 B2 * 10/2018 De Minicis ..... A63C 17/12
10,610,764 B2 * 4/2020 Tyler ..... A63C 17/0093
10,806,989 B2 10/2020 Johnson
11,684,842 B2 * 6/2023 Cappello ..... A63C 17/012 280/87.042
2005/0212246 A1 * 9/2005 Hong ..... A63C 17/12 280/87.042
2007/0029750 A1 * 2/2007 Gregory ..... A63C 17/0086 280/87.042
2015/0202526 A1 * 7/2015 Rawlins ..... A63C 17/017 280/87.042
2018/0104566 A1 * 4/2018 Pielstick ..... F16C 35/042
2018/0161660 A1 * 6/2018 Lu ..... A63C 17/01
2022/0241676 A1 * 8/2022 King ..... A63C 17/002
2024/0382822 A1 * 11/2024 Moore ..... A63C 17/12
2025/0249340 A1 * 8/2025 Pelletier ..... A63C 17/012

* cited by examiner

*Primary Examiner* — Jacob B Meyer

(57) ABSTRACT

A skateboard that is collapsible. There is a collapsible deck having a first end and a second end, the first end is supported and fixedly attached to one support body, the second end is supported and fixedly attached to an opposite support body. The deck is comprised of a plurality of individual slat units in a scissor lift configuration that allows for expansion and contraction of the deck in a linear direction.

23 Claims, 5 Drawing Sheets

COLLAPSIBLE SKATEBOARD

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

This invention deals with a skateboard that is collapsible. Skateboards have been in existence for a number of years and have gone from just a means of athletically inclined people to have a good time, to a means of transportation, especially among college age persons.

In order to enable people to accommodate a skateboard for transportation, or for the athletically inclined persons to conveniently use such boards, it would be convenient to have a means to carry such boards. Such a means is set forth in U.S. Pat. No. 8,459,670 that issued Jun. 11, 2013, to Tizzone in which a long board is disclosed that folds in half. Thus, this board can be conveniently carried in a backpack or the like.

A similar folding skateboard can be found in U.S. Pat. No. 8,827,286 that issued Sep. 9, 2014, to Woncik. The Woncik board folds into three pieces.

U.S. Pat. No. 9,095,766 that issued Aug. 4, 2015 to Christie deals with a skateboard that can transforms into a handheld case. The case provides a storage for the wheel assemblies, and the board when folded, hides the wheels.

U.S. Pat. No. 9,504,901 that issued Nov. 29, 2016 to Lu deals with a folding skateboard with hands free folding operation.

Finally, the inventors herein are aware of multiple skateboard/longboards that fold that are advertised on Amazon.

BRIEF SUMMARY OF THE INVENTION

Thus, what is disclosed and claimed herein is an expandable skateboard. The expandable skateboard comprises a pair of skateboard trucks, the trucks being spaced apart and each truck is modified by a flat plate affixed to a top of the truck.

The flat plate has a front edge and two front corners wherein a tab extends forward at each front edge corner. Each tab has an opening through it.

Each truck has mounted on it, a support body, each support body has a truck locking mechanism housed in it. Each body has attached to it, a spaced apart, parallel housing, comprised of a linearly aligned receiver and sheath. Each housing contains one end of a support rod, and each housing is linearly moveable on the support rod.

There is a collapsible deck having a first end and a second end, the first end is supported and fixedly attached to one support body, the second end is supported and fixedly attached to an opposite support body. The deck is comprised of a plurality of individual slat units in a scissor lift configuration that allows for expansion and contraction of said deck in a linear direction.

BRIEF DESCRIPTION OF THE SEVERAL VIEWS OF THE DRAWING(S)

DETAILED DESCRIPTION OF THE INVENTION

Figure 11:
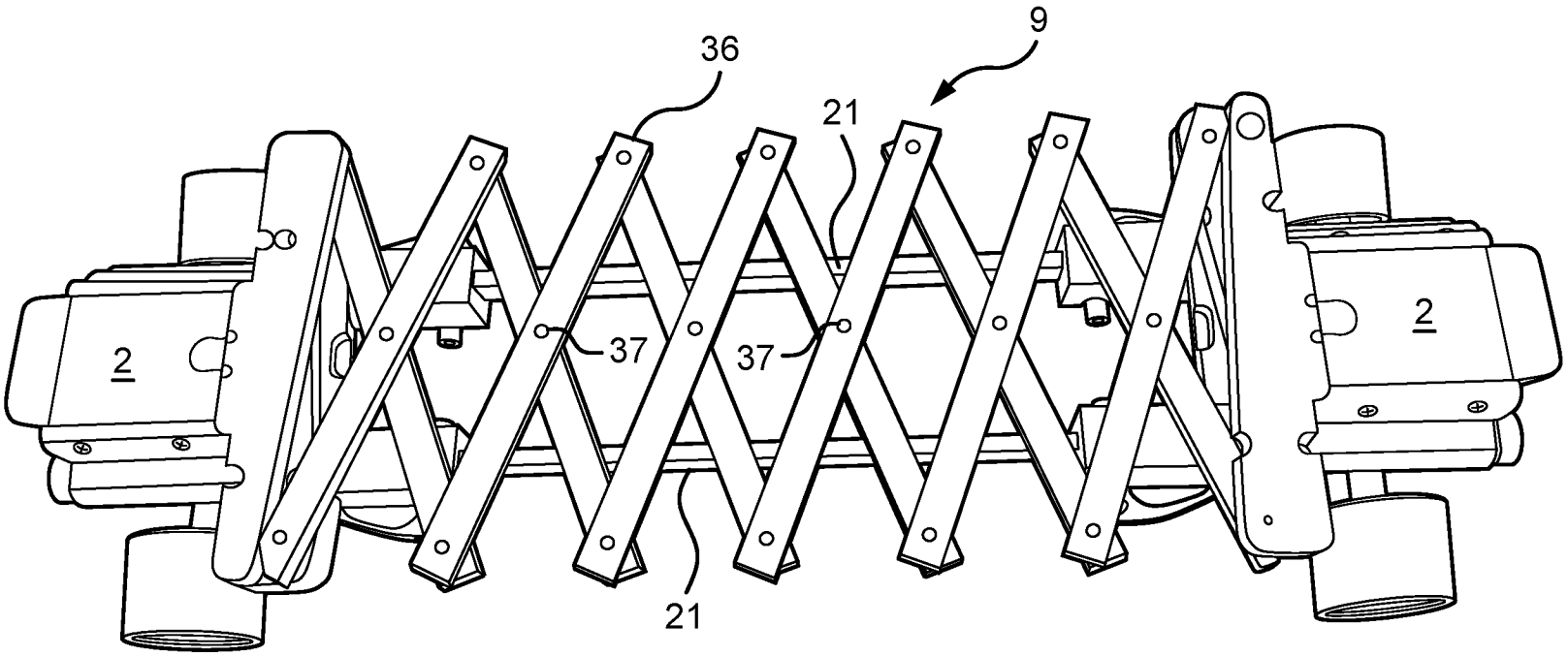
FIG. 11 is a top view of the skateboard in an expanded configuration.
Figure 12:
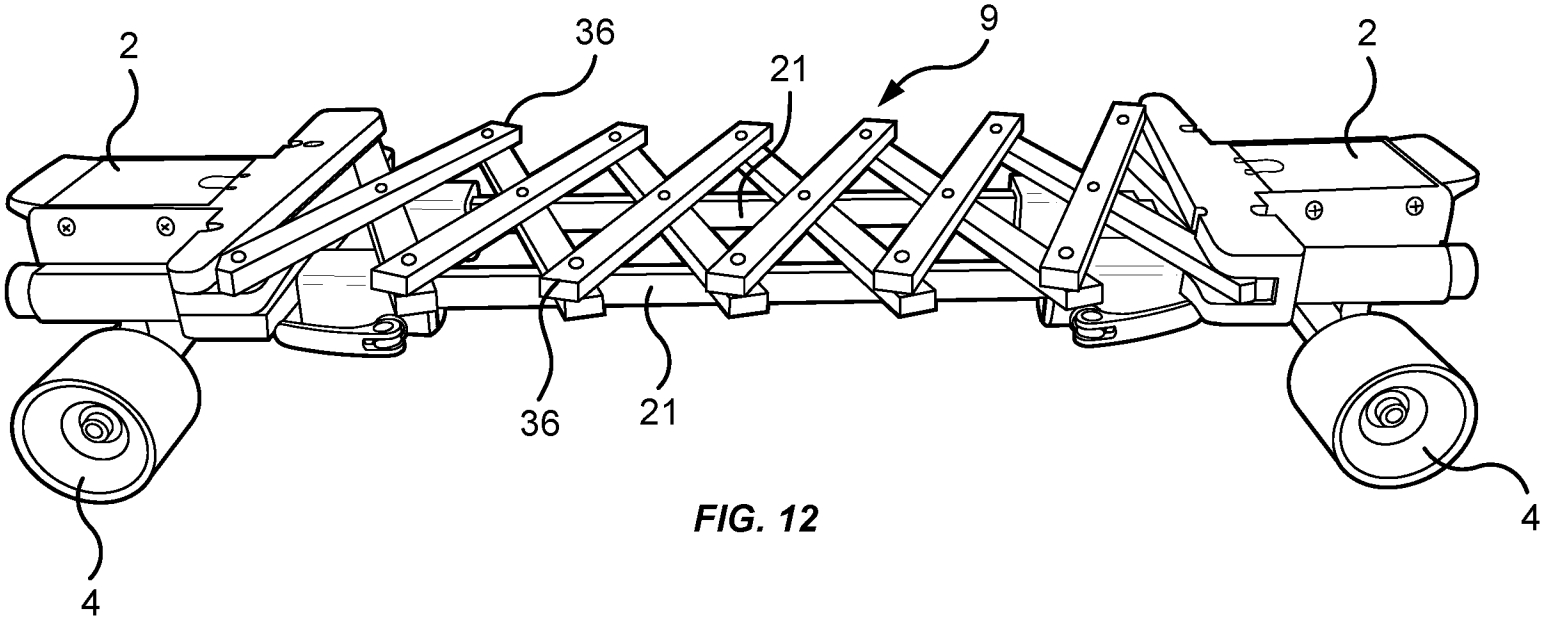
FIG. 12 is a full side view in perspective of the skateboard in an expanded configuration.

This invention deals with an expandable and contractable skateboard 1 (see FIG. 11).

Skateboarding seems to have been born sometime in the late 1940s or early 1950s in the United States. Two main types of skateboards are the longboard and the shortboard.

A skateboard is a type of sports equipment used for skateboarding that is usually made of a wood deck and generally plastic wheels such as, for example, polyurethane wheels attached to the underside of the deck by supporting structures. Today, the combination of the wheels and their support configuration are termed "trucks". That is the definition being used herein.

Figure 1:
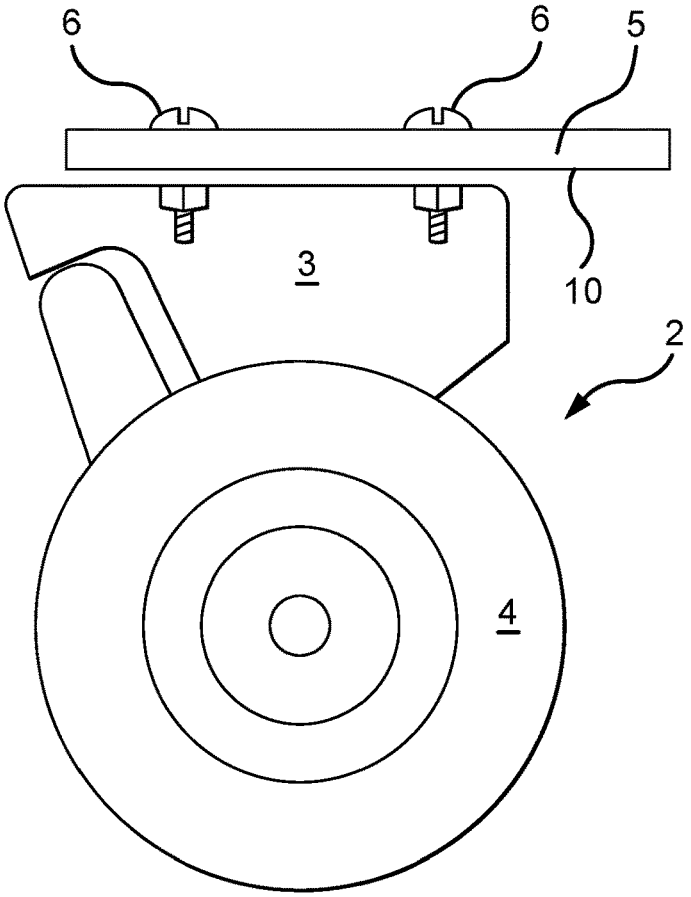
FIG. 1 is a full side view of a truck of this invention.

Turning now to FIG. 1, there is shown a full side view of a modified truck 2 of this invention. There is shown the support structure 3, the wheel 4, and the modified flat plate 5. Note that the flat plate 5 is attached to the support structure 3 by bolts 6. There is a pair of such modified trucks which are identical in structure and operation, one at each end of the deck 9.

Figure 2:
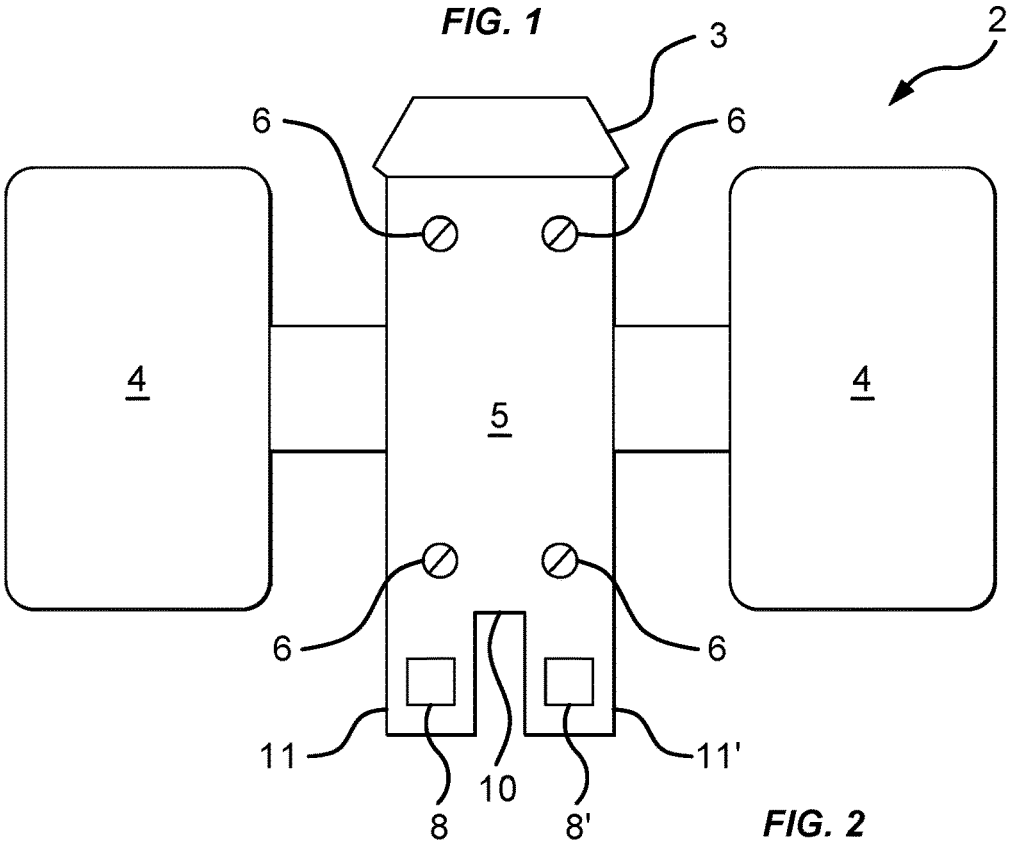
FIG. 2 is a full top view of the truck in FIG. 1.

FIG. 2 is a full top view of the device of FIG. 1 and shows the wheels 4, the bolts 6, the modified flat plate 6, a portion of the support structure 3 and openings 8 and 8'. It should be noted that the flat plate 5 has a front edge 10 and that there are locking tabs 11 and 11' that extend from the front edge 10. These openings 8 and 8' will be discussed in further detail regarding the locking mechanism of the truck 2 to the deck 9.

Figure 3:
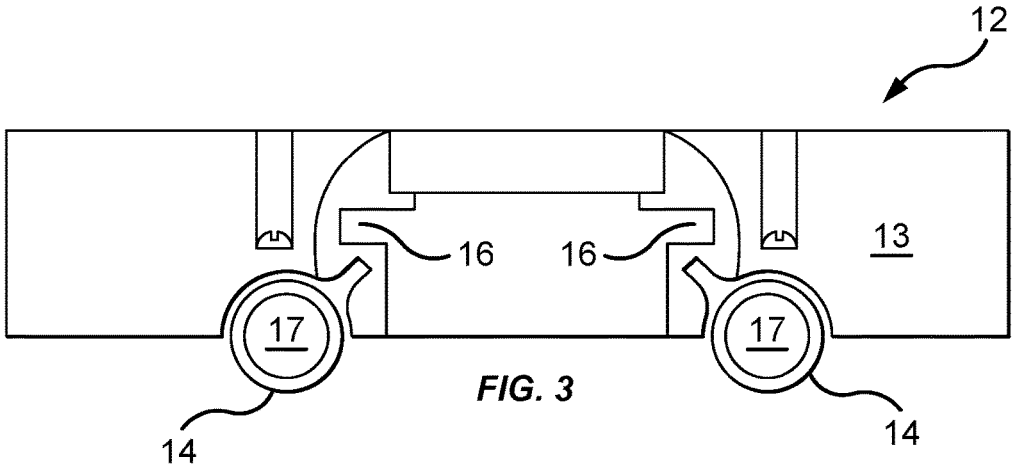
FIG. 3 is a full front-end view of the support body of this invention.
Figure 4:
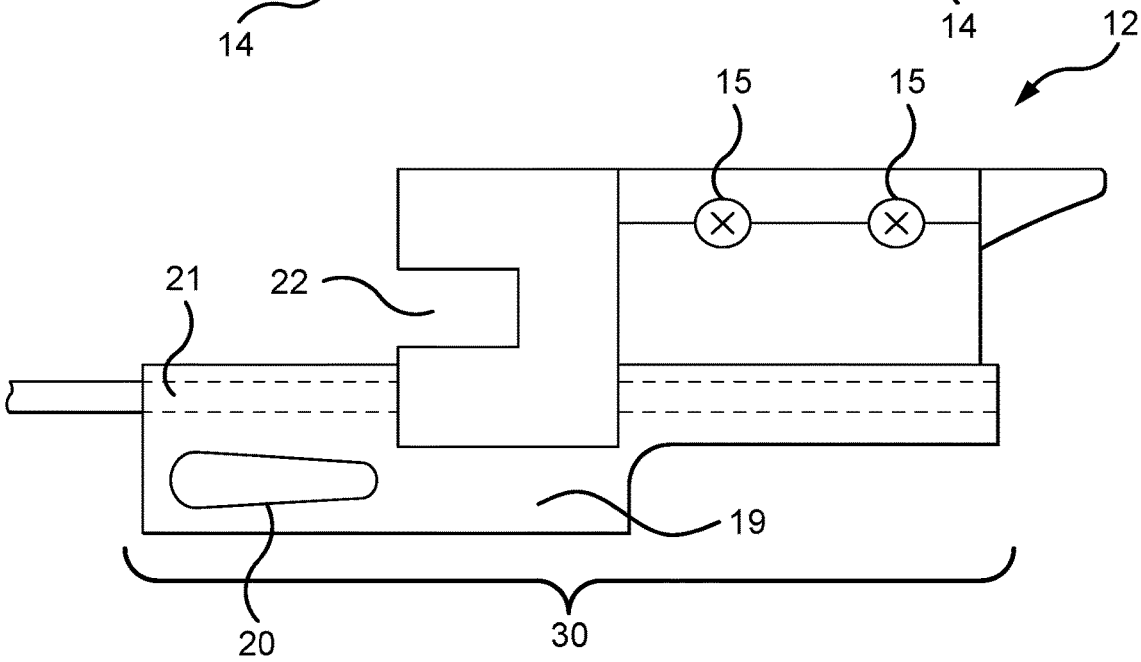
FIG. 4 is an end portion and a full side view of the component of FIG. 3.
Figure 5:
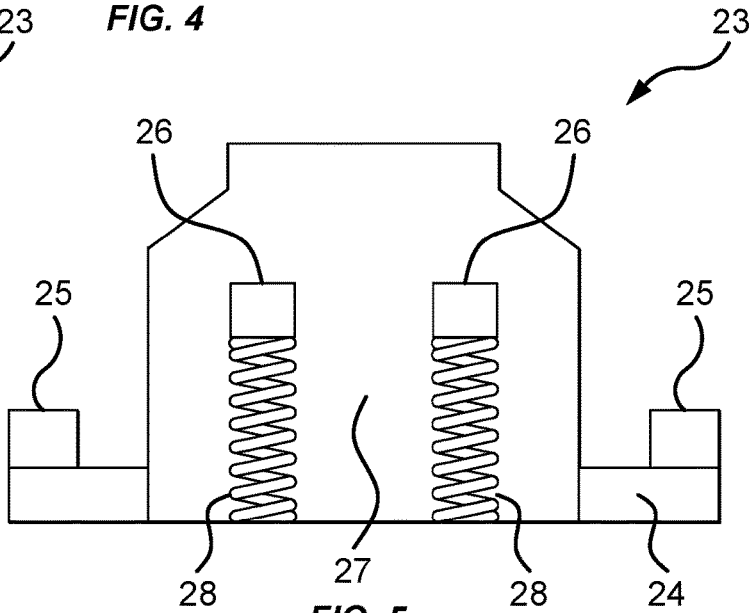
FIG. 5 is a full front view of the lock mechanism for the modified flat-plate.

Turning now to FIGS. 3, 4, and 5, there is shown a full front view of the support body 12 of this invention in FIG. 3. There is shown the body 13, sheaths 14 (which comprise the housing 30), and channels 16. Also shown are end caps 17 for the sheaths 14. The body 13 is attached to the sheaths 14 by bolts or screws 18. The open notches 16 are the locations that the flat plate 5 is inserted into for support. This is also the means by which the modified trucks 2 are supported.

FIG. 4 shows a full side view of the support body 12 along with the sheath 14, the linear receiver 19, the lock mechanism 20, the end cap 17 of the sheath 14, and the bolts or screws 15. Also shown is the deck support rod 21 which is contained in the linear receiver 19 and the sheath 14 when the deck is closed. The designation in FIG. 4 of 22 is the notch in which the lead slat 2 of the deck 9 is located and pivotally attached.

Figure 6:
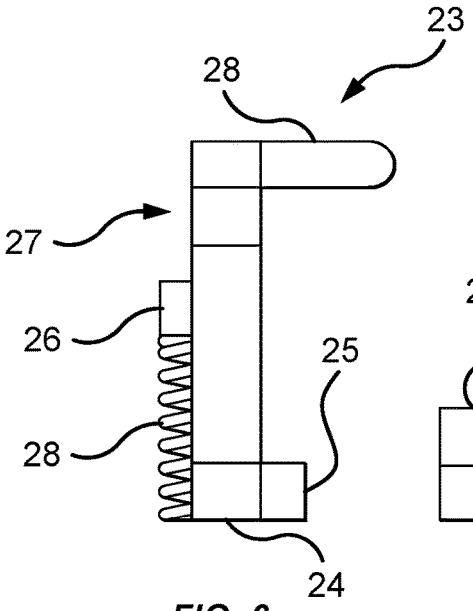
FIG. 6 is a full side view of the lock mechanism of FIG. 5.

FIG. 5 is a full front view of the lock mechanism for the modified flat plate and there is shown a support block 23, having two lateral appendages 24, one at each end at the bottom 29. In addition, there are two offset blocks 25 attached to the lateral appendages 24 such that they do not align linearly with the support block 23 (see FIG. 6). There are two spring blocks 26 attached to the front 27 of the support block. There is a spring 28 attached to the underside of each spring block 26. The lock mechanism works similarly to a safety belt buckle in a vehicle. When the modified flat plate is inserted into the channels 16, the front end of the tabs 11 and 11' are contacted with the offset blocks 25 and the offset blocks 25 insert into the openings 8 and 8'. To release, the release button 28 is pushed down which removes the offset blocks 25 from the openings 8 and 8' in tabs 11 and 11' and the modified flat plate can be removed from the channels 16.

Figure 7:
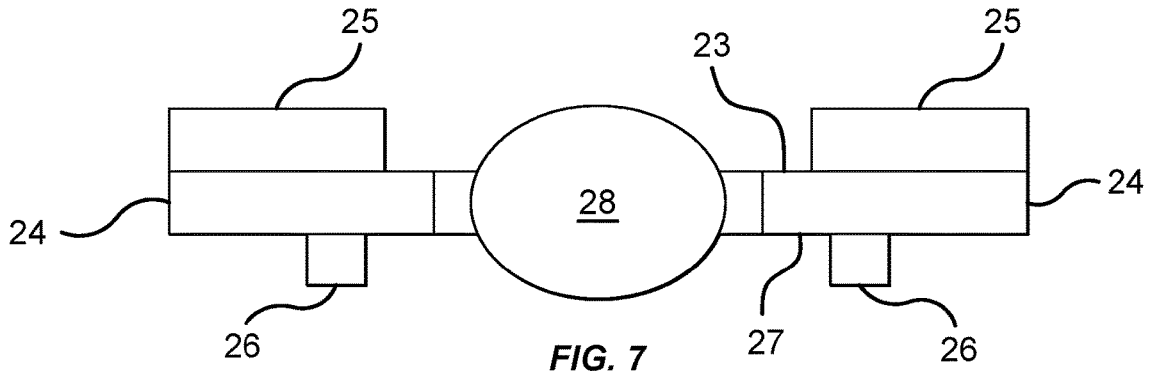
FIG. 7 is a full top view of the lock mechanism of FIG. 5.
Figure 8:
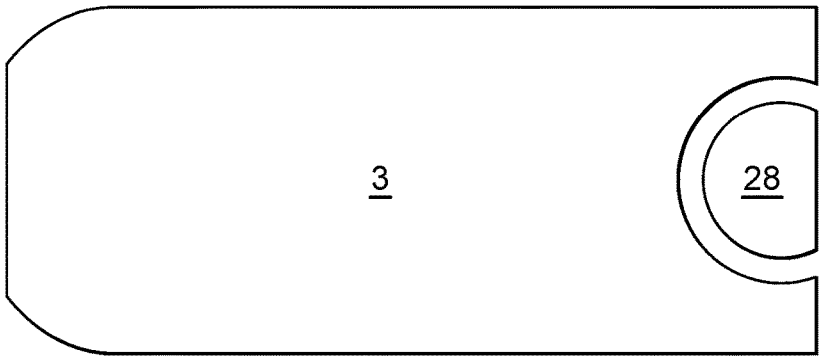
FIG. 8 is a top view of the top of the support structure 3 showing the location of the release button 28.
Figure 9:
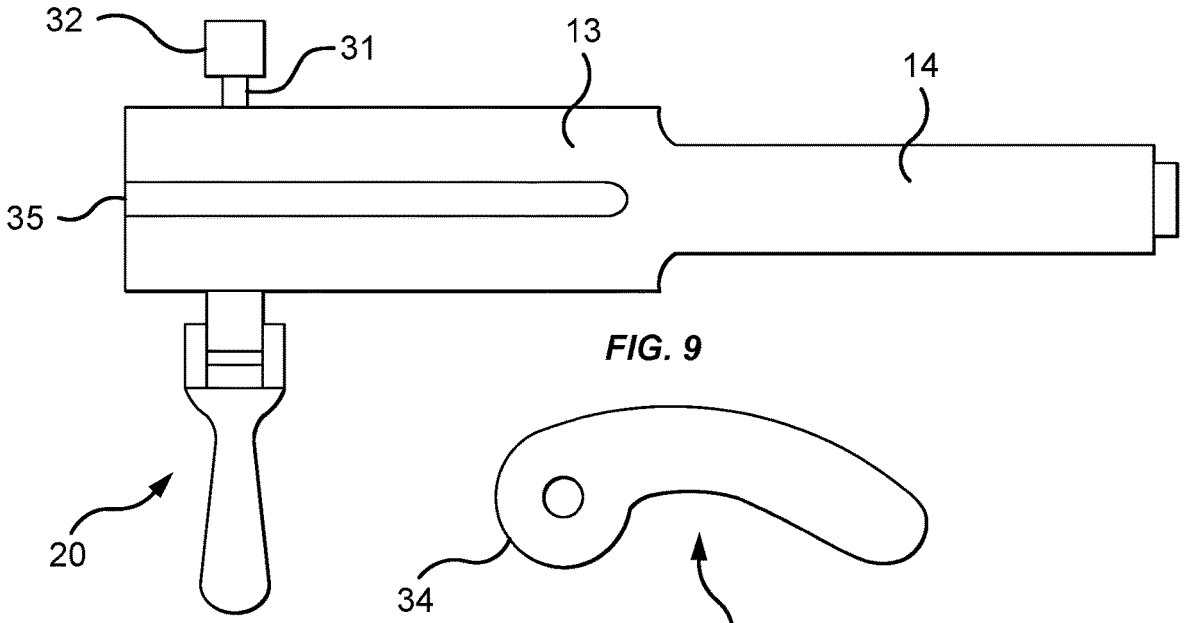
FIG. 9 is a bottom view of the housing 30 showing the lock mechanism for the housing.
Figure 10:
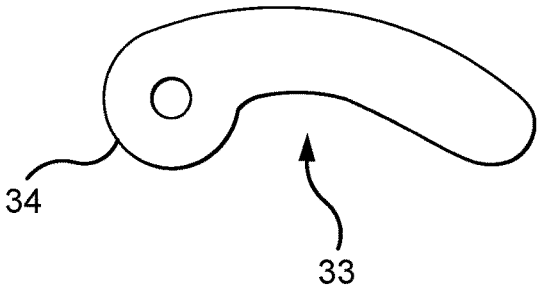
FIG. 10 is a full side view of the handle for the lock mechanism.

FIG. 7 is a full top view of the locking mechanism for the modified truck 2 in which there is shown the support block 23, the lateral appendages 24, the offset blocks 25, the spring blocks 26, the front 27 of the support block 23 and the release button 28.

The locking mechanism is a standard bicycle seat lock and comprises a threaded bolt 31 that has one end a threaded nut 32 for adjusting the pressure on the body 13. Located on the end opposite the nut 32, there is a cammed handle 33 with a cammed front 34 that allows for locking the threaded bolt 31 in place. When the handle is turned toward the body 13, the cam applies pressure to the side of the body 13 to trap the deck support rods 21 in the interior of the housing 30. The slit 35 in the bottom of the body 13 allows for use of the pressure type lock mechanism. There is a lock mechanism for each of the four bodies 13 in the skateboard.

There are parallel, elongated deck support rods 21 (see FIG. 40.) The support rods 21 are supported in the housing 30 such that when the skateboard 1 is collapsed, the housing 30 covers the support rods 21.

The combination of the support rods 21, the support structure 3, and the housings 30 support a deck 9. The deck 9 is comprised of a plurality of individual slat units 36 in a scissor lift configuration that allows for expansion and contraction of the deck 9 in a linear direction. The scissor configuration requires that each slat unit 36 be rotatably attached to the ends of other like slat units 36. There is also such a connection 37 in the middle of the slat units 36. In addition, one end of the end slat unit 36 is secured to the support structure 3 to secure the deck 9 to the support structure 3.

The skateboard 1 of this invention can be as long as 20 to 36 inches, 6 to 12 inches wide and 2 to 10 inches high when expanded. The slat units 36 generally are 8 to 14 inches long, ½ to 1¼ inches wide and ⅛ to ½ inches thick.

The slat units 36 can be manufactured from metals, wood, plastic, and composite materials. Preferred are slat units 36 manufactured from wood such as bamboo, birch, oak, and maple. Most preferred is bamboo and composite materials. Metals that can be used are aluminum, steel and cast iron. Most preferred is aluminum. The slat units can also be manufactured from plastic, such as, polyurethane, vinyl, polypropylene, polyethylene, cross-linked polyethylene, and ABS.

The support rods can be manufactured from metal, plastic, wood, and composite materials, preferred is wood and metal and most preferred is metal. Metals include aluminum, steel, iron and the most preferred is aluminum.

For convenience, the trucks can be separated from the support body, the deck closed, and the entire complement can be easily stored in a knapsack or the like.

What is claimed is:

1. An expandable skateboard, said expandable skateboard comprising:

A) a pair of skateboard trucks, said trucks being spaced apart and each truck being modified by a flat plate affixed to a top of said truck;

said flat plate having a front edge and two front corners wherein a tab extends forward at said each front edge corner, each said tab having an opening therethrough;

B) each said truck having mounted thereon a support body, each said support body having a truck locking mechanism housed therein; each said body having attached thereto spaced apart parallel housings comprised of a linearly aligned receiver and sheath;

C) each said housing containing one end of a support rod, each said housing being linearly moveable on said support rod;

D) a collapsible deck having a first end and a second end, said first end being supported and fixedly attached to one said support body, said second end being supported and fixedly attached to an opposite support body;

E) said deck being comprised of a plurality of individual slat units in a scissor lift configuration that allows for expansion and contraction of said deck in a linear direction.

2. An expandable skateboard as claimed in claim 1 wherein the expandable skateboard in the expanded state is from 20 to 36 inches long, 6 to 12 inches wide, and 2 to 10 inches high.

3. An expandable skateboard as claimed in claim 1 wherein the slat units are 8 to 14 inches long, ¼ to 1/¼ inches wide and ⅛ to ½ inches thick.

4. An expandable skateboard as claimed in claim 3 wherein each said slat unit has through openings in the:

i) center flat surface;

ii) first end flat surface, and iii) second end flat surface.

5. An expandable skateboard as claimed in claim 3 wherein the collapsible deck scissor lift configuration is manufactured with bolts.

6. An expandable skateboard as claimed in claim 5 wherein the collapsible deck scissor lift configuration is manufactured with shoulder bolts.

7. An expandable skateboard as claimed in claim 1 wherein said slat units are manufactured from metal.

8. An expandable skateboard as claimed in claim 7 wherein said metal is aluminum.

9. An expandable skateboard as claimed in claim 1 wherein said slat units are manufactured from wood.

10. An expandable skateboard as claimed in claim 9 wherein the wood is bamboo.

11. An expandable skateboard as claimed in claim 9 wherein the wood is birch.

12. An expandable skateboard as claimed in claim 9 wherein the wood is oak.

13. An expandable skateboard as claimed in claim 9 wherein the wood is maple.

14. An expandable skateboard as claimed in claim 1 wherein said slat units are manufactured from plastic.

15. An expandable skateboard as claimed in claim 1 wherein said slat units are manufactured from composite materials.

16. An expandable skateboard as claimed in claim 1 wherein said support rods lock in place.

17. An expandable skateboard as claimed in claim 1 wherein said support rods are manufactured from metal.

18. An expandable skateboard as claimed in claim 17 wherein said metal is aluminum.

19. An expandable skateboard as claimed in claim 17 wherein the metal is steel.

20. An expandable skateboard as claimed in claim 17 wherein the metal is cast iron.

21. An expandable skateboard as claimed in claim 1 wherein said support rods are manufactured from plastic.

22. An expandable skateboard as claimed in claim 1 wherein said support rods are manufactured from wood.

23. An expandable skateboard as claimed in claim 1 wherein said support rods are manufactured from composite materials.

* * * * *